US007019700B2

(12) United States Patent
Fujii et al.

(10) Patent No.: US 7,019,700 B2
(45) Date of Patent: Mar. 28, 2006

(54) GLASS ANTENNA SYSTEM FOR VEHICLES

(75) Inventors: Hiroyuki Fujii, Matsusaka (JP); Akihiro Noguchi, Matsusaka (JP)

(73) Assignee: Central Glass Company, Limited, Ube (JP)

( * ) Notice: Subject to any disclaimer, the term of this patent is extended or adjusted under 35 U.S.C. 154(b) by 0 days.

(21) Appl. No.: 10/972,772

(22) Filed: Oct. 26, 2004

(65) Prior Publication Data

US 2005/0140555 A1 Jun. 30, 2005

(30) Foreign Application Priority Data

Oct. 27, 2003 (JP) ..... 2003-366715

(51) Int. Cl.
*H01Q 1/32* (2006.01)

(52) U.S. Cl. ..... 343/713

(58) Field of Classification Search ..... 343/713, 343/711, 712, 704
See application file for complete search history.

(56) References Cited

U.S. PATENT DOCUMENTS 4,058,813 A * 11/1977 Risko ..... 343/786
4,707,702 A * 11/1987 Withers ..... 343/786
4,896,163 A * 1/1990 Shibata et al. ..... 343/786
5,610,619 A 3/1997 Zafar
6,011,524 A * 1/2000 Jervis ..... 343/895

FOREIGN PATENT DOCUMENTS

JP 9-172315 6/1997
JP 2001-168623 6/2001

* cited by examiner

*Primary Examiner*—Shih-Chao Chen
*Assistant Examiner*—Huedung X. Cao
(74) *Attorney, Agent, or Firm*—Crowell & Moring LLP

(57) ABSTRACT

A vehicular rear glass antenna system includes a rear window glass sheet, a defogger formed on a lower part of the glass sheet, and an antenna formed on an upper part of the glass sheet. This antenna includes (a) a feed point located at a position that becomes adjacent to a top or side member of a metal rear window frame of a vehicle body; (b) a horizontal strip that is connected to the feed point and becomes adjacent to the top member of the rear window frame; (c) a vertical strip downwardly extending from an end point of the horizontal strip; (d) a first return strip horizontally extending from a lower end of the vertical strip toward the feed point; and (e) a second return strip horizontally extending from a middle point of the vertical strip toward the feed point.

8 Claims, 5 Drawing Sheets

GLASS ANTENNA SYSTEM FOR VEHICLES

BACKGROUND OF THE INVENTION

The present invention relates to a glass antenna system for vehicles (e.g., automobiles), in which an antenna for receiving AM/FM radio waves and TV waves is formed on an upper part of the rear window glass sheet, while heater strips of a defogger are formed on a lower part of the rear window glass.

There are many automotive glass antenna systems in which the defogger is also used as an antenna for receiving AM/FM radio waves and TV waves In this case, it is necessary to adjust the antenna for each automobile type, since the defogger pattern and a feed line from a direct current power source to the defogger are different in each automobile type and since the antenna receiving property and the like are different by the length of this feed line.

In some glass antenna systems, the antenna pattern (grid) is disposed at a position that is away from the defogger by a certain distance in order to reduce adverse effects (e.g., noise) of the defogger on the antenna system.

U.S. Pat. No. 5,610,619, corresponding to Japanese Patent Laid-open Publication 9-172315, discloses such antenna system for an AM/FM vehicle radio. The antenna grid of this system includes a plurality of equally spaced, horizontal antenna elements, an L-shaped element connected to one of end bus bars, and a T-shaped element extending between the antenna grid and the heater grid.

Japanese Patent Laid-open Publication 2001-168623 discloses another antenna system having a loop element connected to a feed point and upper and lower elements extending from the left side of the loop element. It is described in this publication that the distance between the lower element and the top heater strip is preferably from 30 mm to 50 mm.

SUMMARY OF THE INVENTION

It is an object of the present invention to provide a glass antenna system for vehicles, which can obtain a high antenna receiving gain for FM radio broadcast waves having a frequency band of 76–90 MHz and FM radio broadcast waves having a frequency band of 88–108 MHz and can also receive AM radio broadcast waves and TV broadcast waves very well.

According to the present invention, there is provided a glass antenna system for a vehicle. This glass antenna system includes:

a rear window glass sheet;

a defogger formed on a lower part of the glass sheet, the defogger having horizontal heater strips and positive and negative bus bars for feeding an electric current to the heater strips; and an antenna formed on an upper part of the glass sheet. This antenna includes:

(a) a feed point located at a position that is adjacent to a top or side member of a metal rear window frame of the vehicle, when the rear window glass sheet is fixed to the rear window frame;

(b) a first horizontal strip connected to the feed point, the first horizontal strip being adjacent to the top member of the rear window frame, when the rear window glass sheet is fixed to the rear window frame, to achieve a capacitive coupling with the rear window frame, the first horizontal strip extending across a vertical center line of the glass sheet to an end point such that a length defined from the feed point to the end point of the first horizontal strip is equal to "$\alpha\lambda/2$" where $\lambda$ represents a wavelength of a received frequency and $\alpha$ represents a wavelength shortening coefficient of 0.4 to 0.6;

(c) a first vertical strip vertically extending from the end point of the first horizontal strip toward the heater strips;

(d) a first return strip horizontally extending from a lower end of the first vertical strip toward a side of the feed point, the first return strip being away from the heater strips such that a distance between the first return strip and a top of the heater strips is equal to one-third or more of a distance between the top of the heater strips and the top member of the rear window frame when the rear window glass sheet is fixed to the rear window frame; and (e) a second return strip horizontally extending from a middle point of the first vertical strip toward the side of the feed point, wherein a total length of the first vertical strip and the first return strip is equal to "$\beta\lambda/4$" where $\lambda$ is defined as above and $\beta$ represents a wavelength shortening coefficient of about 0.7.

DETAILED DESCRIPTION

According to the present invention, the antenna formed on an upper part of a rear window glass sheet is arranged at a position that becomes adjacent to a top member of a metal, flanged, rear window frame of a vehicle body, when the rear window glass sheet is fixed to the rear window frame With this, it is possible to achieve a capacitive coupling with a metal flange of the top member. Thus, it becomes possible to increase the receiving gain of an FM radio broadcast band by picking up radio waves received by the metal vehicle body. Furthermore, according to the present invention, the antenna is away from the top heater strip to have a distance between the first return strip and the top heater strip that is equal to one-third or more of a distance between the top heater strip and the top member of the rear window frame when the rear window glass sheet is fixed to the rear window frame. With this, it becomes possible to increase the receiving gain of FM radio broadcast band by suppressing the effect of the defogger on the antenna. Furthermore, it becomes possible to reduce the noise mixing from the heater strips (heater grid) of the defogger with respect to the AM ratio broadcast band.

In particular, it is possible by the present invention to increase the antenna receiving gain of not only an FM radio band of 76 MHz to 90 MHz, but also an FM radio band of 88 MHz to 108 MHz and TV broadcast band, to a degree comparable to that of whip antenna.

With reference to FIGS. 1–10, vehicular glass antenna systems according to the present invention are exemplarily described in detail in the following.

Figure 1:
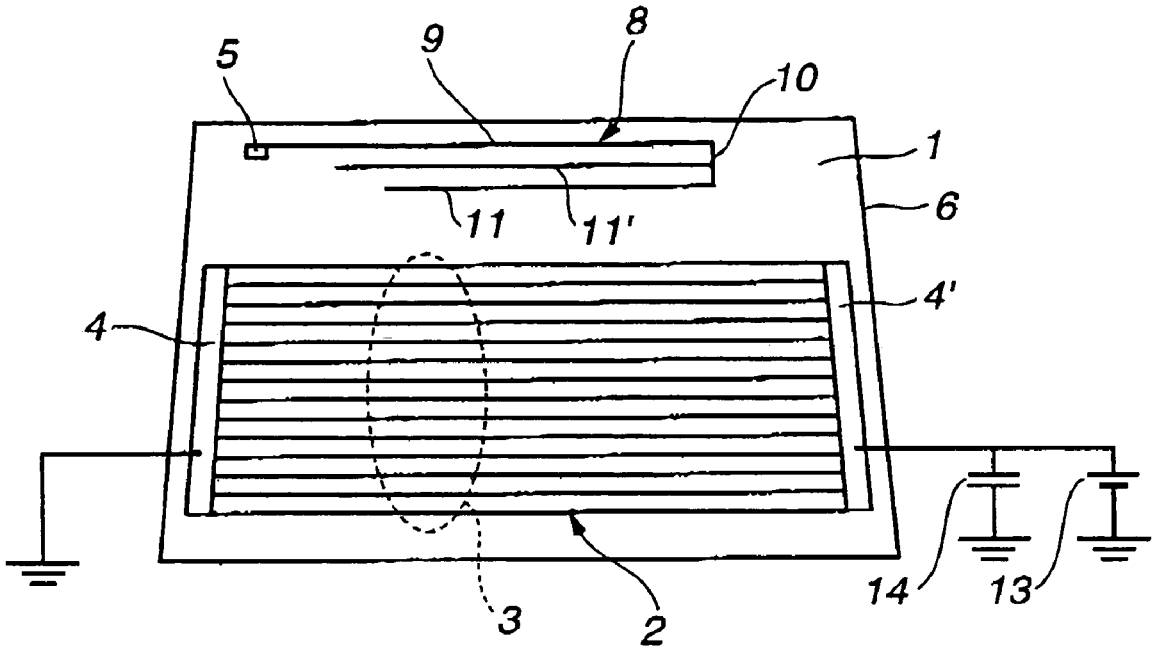
FIGS. 1–4 are front views respectively showing glass antenna systems according to the first to fourth embodiments of the present invention.

For example, as shown in FIG. 1, the glass antenna system has a rear window glass 1 of a vehicle (e.g., automobile). A defogger 2 for achieving defogging of the rear window glass 1 is formed on a lower part of the rear window glass 1. The defogger 2 has horizontal heater strips 3 that extend in a substantially horizontal direction and negative and positive bus bars 4, 4' that are connected to ends of the heater strips 3 and feed electric current to the heater strips 3. The antenna 8 is formed on an upper part (an upper remaining space) of the rear window glass 1. The antenna 8 of the present invention can receive an AM/FM radio band very well. This antenna can also receive a VHF band of TV broadcast waves. In particular, this antenna can obtain a very high receiving sensitivity with respect to FM radio broadcast waves of 76 MHz to 108 MHz and is not susceptible to influences from the defogger and the vehicular shape.

The antenna 8 has a feed point 5 located at a position that is adjacent to a top or side flanged member of the metal rear window frame, when the rear window glass sheet is fixed to the rear window frame. For example, the feed point 5 can be located at a first position (see FIGS. 1 and 2) near the upper corner of a generally rectangular metal flange 6 of the rear window frame. As another example, it can be located at a second position (see FIGS. 3 and 4) near the side edge of the metal flange 6.

In connection with the metal flange 6 shown in FIGS. 1–4, it should be noted that each of FIGS. 1–4 shows a condition in which the rear window glass sheet 1 is fixed to the rear window frame of the vehicle body. The rear window glass sheet's peripheral portion that is generally rectangular in shape and overlaps the rear window frame is omitted in FIGS. 1–4 for simplification. In other words, the perimeter line 6 does not define the glass outer perimeter of the rear window glass sheet 1, but defines the inner perimeter of the metal flange of the rear window frame, when the rear window glass sheet 1 is fixed to the rear window frame.

The antenna 8 has a first horizontal strip 9 connected to the feed point 5. The first horizontal strip 9 is adjacent to the top edge of the metal flange 6, when the rear window glass sheet is fixed to the rear window frame, to achieve a capacitive coupling with a metal body of the vehicle. The first horizontal strip 9 extends across a vertical center line of the glass sheet 1 to an end point.

Figure 2:
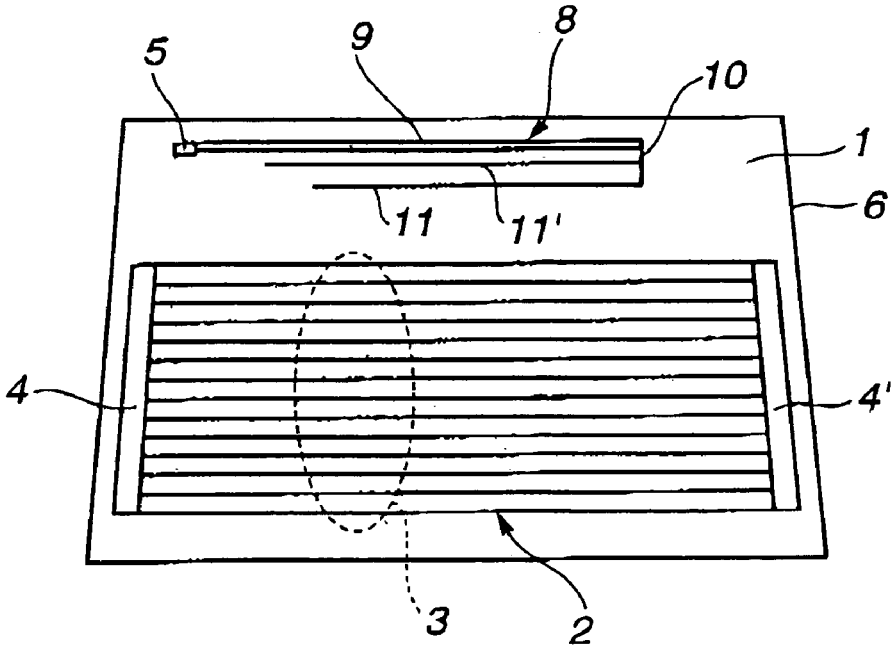

The first horizontal strip 9 can directly be connected to the feed point 5, in case that the feed point 5 is located at the first position (see FIGS. 1 and 2). Alternatively, a vertical supplementary strip that extends along the side edge of the metal flange 6 can be disposed between the feed point 5 and the first horizontal strip 9, in case that the feed point 5 is located at the second position (see FIGS. 3 and 4). The resulting L-shaped strip (i.e., a combination of the vertical supplementary strip and the first horizontal strip 9) can be treated as the first horizontal strip 9 in the invention.

The antenna 8 has a first vertical strip 10 vertically extending from the end point of the first horizontal strip 9 toward the heater strips 3, and first and second return strips 11, 11' extending horizontally respectively from the lower end and a middle point of the first vertical strip 10 toward the side of the feed point 5.

Figure 3:
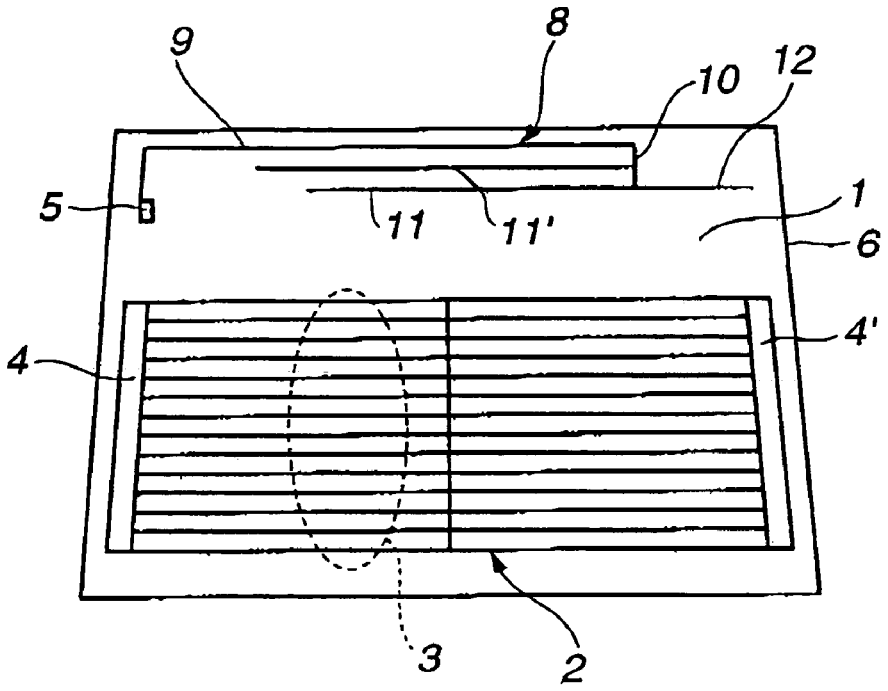
Figure 4:
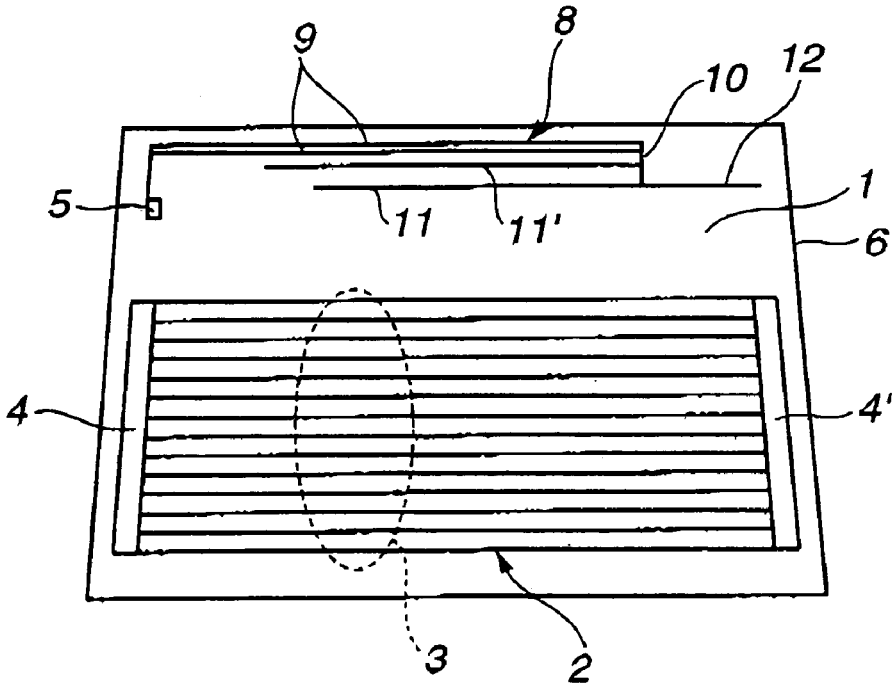

As shown in FIGS. 3 and 4, the antenna 8 may have a horizontal supplementary strip 12 extending from the lower end of the first vertical strip 10 in a direction that is opposite to the side of the feed point 5. This horizontal supplementary strip 12 is effective not only for impedance matching with an amplifier and a radio connected to the antenna, but also for improving the receiving gain of AM radio broadcast waves.

An antenna length defined from the feed point 5 to the end point of the first horizontal strip 9 is equal to "$\alpha\lambda/2$" where $\lambda$ represents a wavelength of a received frequency and a represents a wavelength shortening coefficient of about 0.5 or from 0.4 to 0.6. In the case of FIGS. 3 and 4, this antenna length can be defined as the total length of the first horizontal strip 9 and the vertical supplementary strip arranged between the feed point 5 and the first horizontal strip 9. In fact, this wavelength $\lambda$ can be defined as an intermediate wavelength of a receiving frequency and may be from 2.8 m to 4.0 m.

When the above-defined antenna length is equal to "$\alpha\lambda/2$", the following advantages can be obtained. Firstly, the first horizontal strip 9 can transmit the FM band broadcast waves, which have been received on the first vertical strip 10 and the first return strip 11, to the feed point 5 without transmission loss. Secondly, it becomes possible to dispose the first vertical strip 10 and the first return strip 11 as an antenna receiving element at a center portion of the rear window glass sheet, at which the receiving efficiency becomes the highest, with respect to the horizontal direction of the glass sheet. Thirdly, it becomes possible to efficiently pick up the FM radio broadcast waves received on the metal body of the vehicle, thereby further improving the receiving gain.

The total length of the first vertical strip 10 and the first return strip 11 is equal to "$\beta\lambda/4$" where $\lambda$ is defined as above and $\beta$ represents a wavelength shortening coefficient of about 0.7. With this, it is possible to make the first vertical strip 10 and the first return strip 11, which are disposed at the center portion, function as a short, high-receiving-efficiency antenna element for receiving the FM band broadcast waves with the highest efficiency. It is optimum to adjust the above total length to "$\beta\lambda/4$", in view of the size of the glass sheet 1.

It is generally known that the radio wave wavelength is shortened by the transmission through a glass sheet. In connection with this phenomenon, it is general that the wavelength shortening coefficient with respect to an automotive rear window glass sheet is about 0.7. It was, however, found by the inventors that the wavelength shortening coefficient $\alpha$ related to the first horizontal strip 9 is about 0.5 due to the position of the first horizontal strip 9 close to the vehicular metal body.

The first return strip 11 is away from the heater strips (heater grid) 3 such that the distance between the first return strip 11 and the top heater strip is equal to one-third or more of the distance between the top heater strip and the top member of the rear window frame when the rear window glass sheet 1 is fixed to the rear window frame. For example, this distance may be from 60 mm to 150 mm. Thus, it is possible to make the antenna not susceptible to influences from the defogger. It is understood from FIG. 9 that the AM band antenna S/N ratio becomes superior (due to less noise effect of the defogger on the AM band antenna) as this distance becomes longer and that the AM band antenna S/N ratio is particularly good in case that this distance is 60 mm or longer.

As shown in FIGS. 2 and 4, the first horizontal strip 9 may be in the form of a pair of parallel strips, of which both first and second ends are closed. In this case, it has a closed loop shape. With this, it becomes possible to reduce Q value that is indicative of resonance sharpness (strength). Thus, the antenna has wide-band frequency characteristics. The first and second ends may respectively be connected to the feed point 5 and the first vertical strip 10. The distance between the parallel strips may be from about 3 mm to about 10 mm. With this, it is possible to obtain good frequency characteristics.

The distance between the first horizontal strip 9 and the top inner edge of the metal flange 6 of the rear window frame may be from 1 mm to 10 mm in order to achieve a capacitive coupling with the metal body of the vehicle. It is understood from FIG. 10 that the FM band antenna gain becomes higher as this distance is shorter and that the FM band antenna gain becomes superior particularly when this distance is 10 mm or shorter. Furthermore, the first horizontal strip 9 is extended across the vertical center line of the glass sheet 1. Thus, it is possible to increase the antenna receiving gain by picking up the radio waves received on the metal body by capacitive coupling.

The distance between the first horizontal strip 9 and the first return strip 11, that is, the length of the first vertical strip 10, may be from 40 mm to 100 mm.

As shown in FIG. 1, the glass antenna system may have a circuit having at least a capacitor 14, which is provided between and connected to the positive bus bar 4' and the body earth (i.e, a vehicle body as earth). Furthermore, this circuit may be in a parallel connection with a direct current power source 13. With this, it becomes possible to reduce a noise from the feed line into the defogger 2. Thus, it becomes possible to further reduce noise mixing into the antenna upon receiving AM radio broadcast waves.

The antenna of the invention can be used alone as a vehicular antenna for receiving FM radio broadcast waves, AM radio broadcast waves and TV broadcast waves. Furthermore, it is optional to construct a diversity reception system by combining the antenna of the invention with another antenna on the rear window glass, an antenna formed on a front windshield, an antenna formed on a side window glass sheet, and/or a pole antenna (e.g., whip antenna).

The following nonlimitative embodiments are illustrative of the present invention.

First Embodiment

In this embodiment, a vehicular glass antenna system shown in FIG. 1 was prepared, as explained in detail as follows.

A rear window glass sheet 1 used was generally trapezoidal in shape (top surface: 1,230 mm; bottom surface: 1,500 mm; side surface: 780 mm).

The antenna 8 having a structure shown in FIG. 1 was formed on an upper part of the rear window glass 1 by printing a conductive paste and then by baking the antenna pattern. The resulting antenna 8 had the following dimensions.

Length of the first horizontal strip 9: 800 mm;

Length of the first vertical strip 10: 65 mm;

Length of the first return strip 11: 420 mm

Length of the second return strip 11': 500 mm

Distance between the first horizontal strip 9 and the top inner edge of the metal flange 6: 5 mm;

Distance between the first horizontal strip 9 and the second return strip 11': 35 mm;

Distance between the first and second return strips 11, 11': 30 mm; and

Distance between the first return strip 11 and the top heater strip 3: 80 mm.

The resulting rear window glass with the defogger 2 and the antenna 8 was fixed to the automotive rear window frame. Then, the negative bus bar 4 was grounded to the body, and the positive bus bar 4' was grounded with a parallel connection to the direct current source 13 and the capacitor (capacity: 4.7 μF) 14.

Under a condition that the glass antenna system was connected with the direct current source circuit, a vertically polarized wave of a foreign FM radio broadcast band of 88 MHz to 108 MHz was received by the antenna. As a result, the average gain (in terms of the gain difference provided that the receiving gain of a dipole antenna is 0 dB) was −8.7 dB. Considering that the gain of whip antenna is about −8.0 dB, it is understood that the antenna according to this embodiment is a very good antenna comparable to whip antenna in receiving gain for a tuned band of 88 MHz to 108 MHz. Furthermore, it is possible to further improve the FM band receiving gain by using an amplifier (not shown in the drawings).

Figure 5:
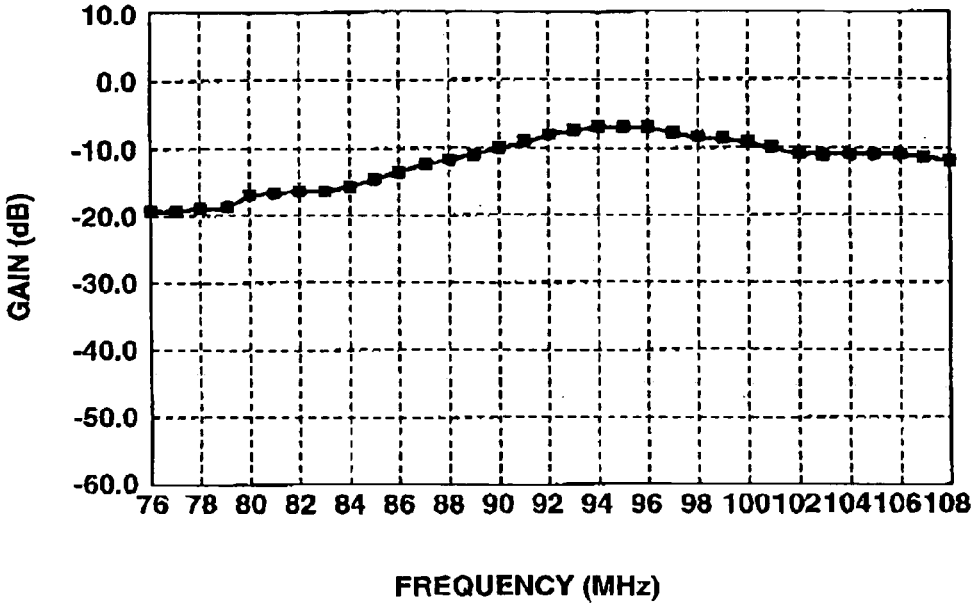
FIG. 5 is a graph showing frequency characteristics of an FM radio band of 76 MHz to 108 MHz in the first embodiment of the present invention.

As shown in FIG. 5, it is possible by the antenna of this embodiment to obtain a high receiving gain for a wide band of 88 MHz to 108 MHz.

Figure 6:
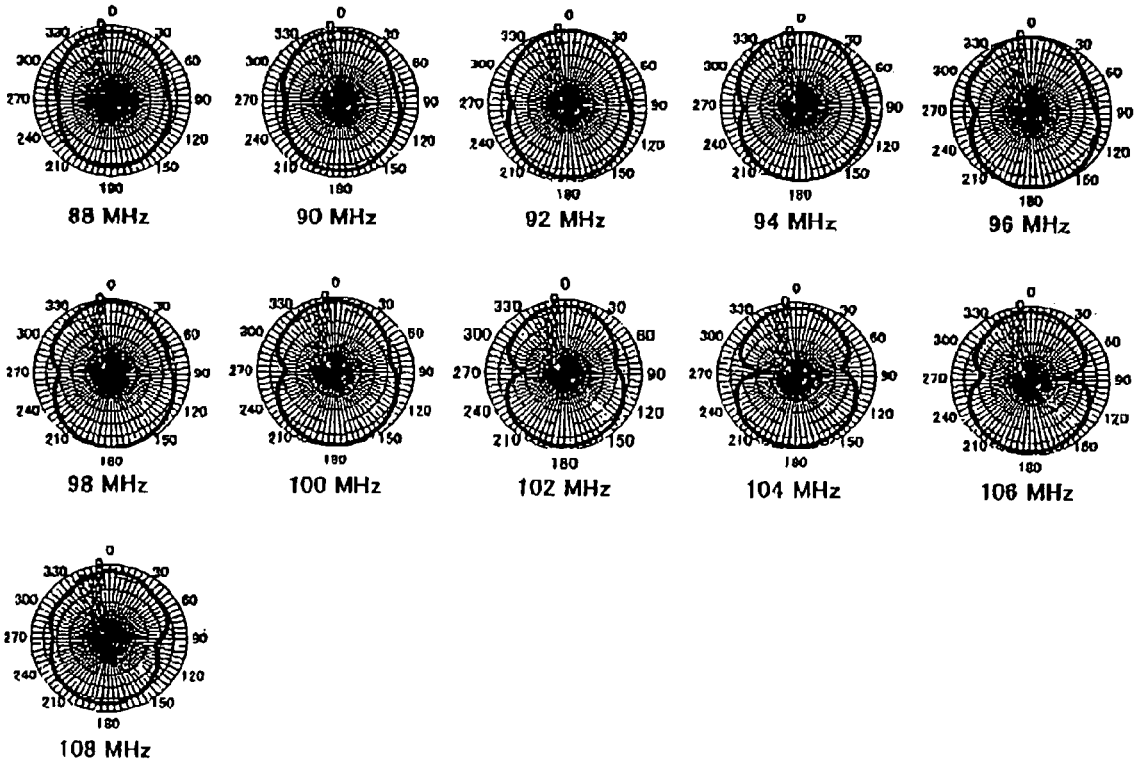
FIG. 6 is a graph showing directional characteristics at each predetermined frequency of an FM radio band of 88 MHz to 108 MHz in the first embodiment of the present invention.

Furthermore, as shown in FIG. 6, it is possible by the antenna of this embodiment to obtain good directional characteristics in an FM radio broadcast wave band of 88 MHz to 108 MHz.

The receiving capacity of the antenna was measured by receiving radio waves of an AM radio band of 500 KHz to 1700 KHz under a condition that an amplifier (not shown in the drawings) was connected to the glass antenna system. With this, noise was low throughout this band, and the S/N ratio was higher than that of whip antenna. Therefore, it was understood that the antenna of this embodiment was also a very good antenna for AM radio broadcast wave band.

Similarly, the receiving capacity of the antenna was measured by receiving waves of a TV broadcast wave band of 90 MHz to 108 MHz. With this, it was found to have a receiving capacity comparable to that of whip antenna throughout this band. Therefore, it was understood that the antenna of this embodiment was also a very good antenna for TV broadcast wave band.

Second Embodiment

The glass antenna system of this embodiment shown in FIG. 2 was the same as that of the first embodiment, except in that the first horizontal strip 9 was in the form of a closed loop (see FIG. 2), of which one end is connected with the feed point 5 and of which the other end is connected with the first vertical strip 10. The distance between parallel strips of this closed loop was 5 mm.

The resulting rear window glass with the defogger 2 and the antenna 8 was fixed to the rear window frame. Although not shown in FIG. 2, the negative and positive bus bars 4 and 4' were respectively connected in the same manners as those of FIG. 1.

Under a condition that the glass antenna system was connected with the direct current source circuit, a vertically polarized wave of a foreign FM radio broadcast band of 88 MHz to 108 MHz was received by the antenna. As a result, the average gain (in terms of the gain difference provided that the receiving gain of a dipole antenna is 0 dB) was −7.6 dB. Considering that the gain of whip antenna is about −8.0 dB, it is understood that the antenna according to this embodiment is a very good antenna superior to whip antenna in receiving gain for a tuned band of 88 MHz to 108 MHz.

Furthermore, good frequency characteristics and good directional characteristics similar to those of the first embodiment were obtained.

The receiving capacity of the antenna was measured by receiving radio waves of an AM radio band of 500 KHz to 1700 KHz under the same condition as that of the first embodiment. With this, a receiving gain similar to that of the first embodiment was obtained. Thus, the antenna of this embodiment was also found to be a very good antenna for AM radio broadcast wave band.

Similarly, the receiving capacity of the antenna was measured by receiving radio waves of a TV broadcast wave band of 90 MHz to 108 MHz. With this, a receiving gain similar to that of the first embodiment was obtained. Thus, the antenna of this embodiment was also found to be a very good antenna for TV broadcast wave band.

As mentioned above, the first horizontal strip 9 was in the form of a closed loop of a pair of parallel strips. With this, it was possible to obtain a higher receiving gain for the FM radio broadcast wave band and to improve the antenna gain in the AM radio broadcast wave band, as compared with the first embodiment.

Third Embodiment

In this embodiment, a glass antenna system according to the first embodiment was modified in that the feed point 5 was formed at a position adjacent to the side edge of the metal flange 6 of the rear window frame, that a vertical supplementary strip was disposed between the feed point 5 and the first horizontal strip 9, and that a horizontal supplementary strip 12 was extended from the lower end of the first vertical strip 10 in a direction that is opposite to the side of the feed point 5, as shown in FIG. 3.

It was possible to improve the antenna gain in the AM radio broadcast wave band due to the addition of the horizontal supplementary strip 12

Figure 7:
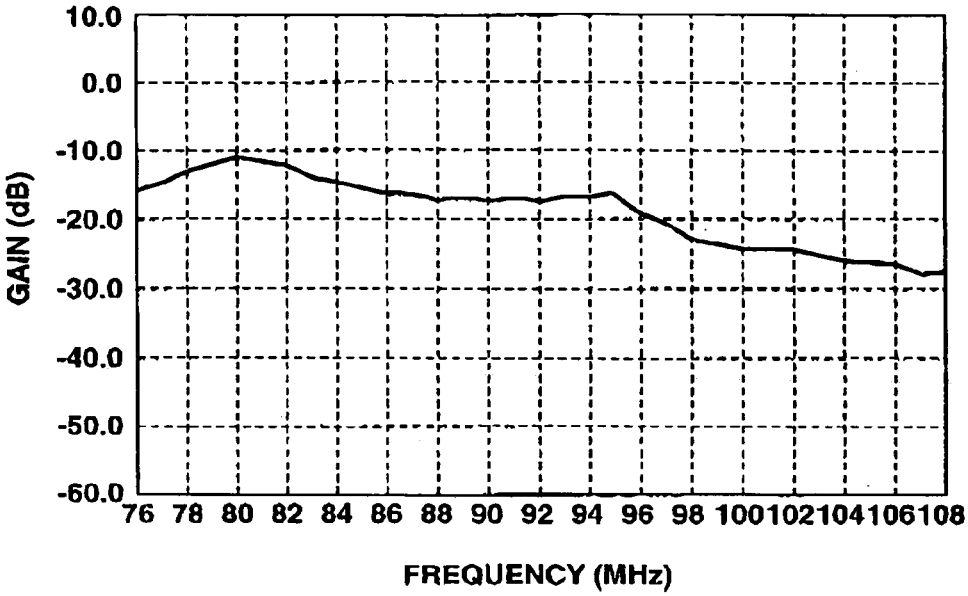
FIG. 7 is a graph similar to FIG. 5, but showing frequency characteristics in the third embodiment of the present invention.

As shown in FIG. 7, the antenna of this embodiment was found to have a high gain in a wide band of 76 MHz to 90 MHz.

Figure 8:
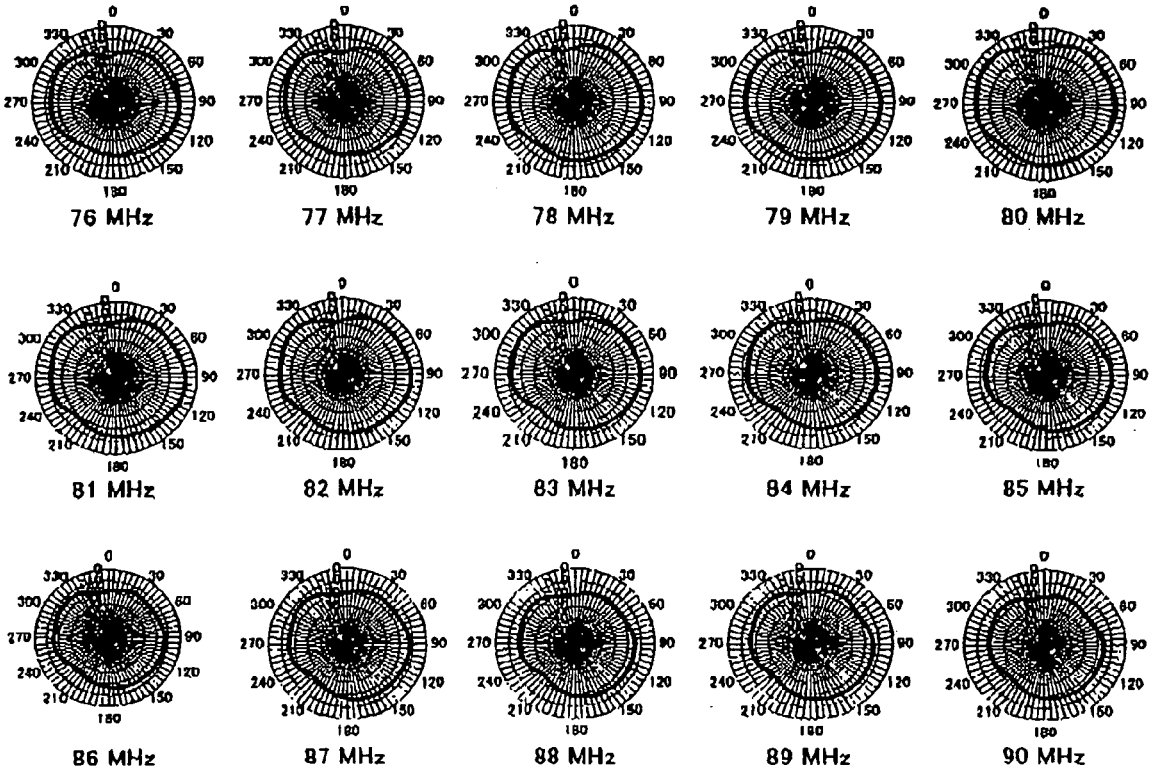
FIG. 8 is a graph similar to FIG. 6, but showing directional characteristics at each predetermined frequency of an FM radio band of 76 MHz to 90 MHz in the third embodiment of the present invention.
Figure 9:
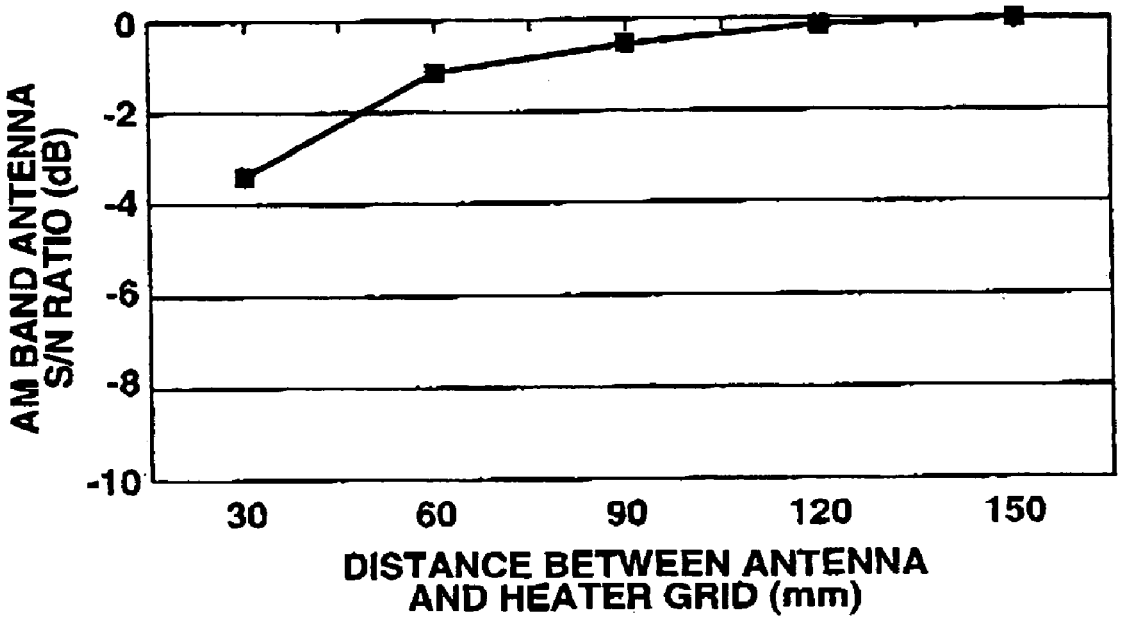
FIG. 9 is a graph showing the change of the AM radio band antenna S/N ratio by the distance between the antenna and the heater grid in the first embodiment of the present invention.
Figure 10:
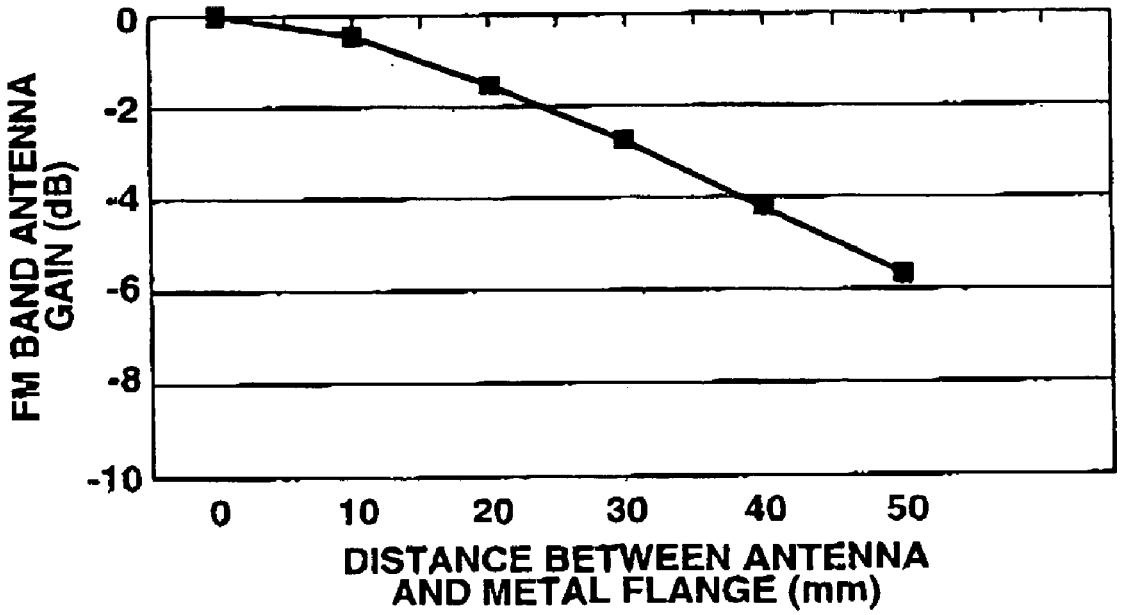
FIG. 10 is a graph showing the change of the FM radio band antenna gain by the distance between the antenna and the metal flange in the first embodiment of the present invention.

As shown in FIG. 8, the antenna of this embodiment was found to have good directional characteristics in an FM radio broadcast wave band of 76 MHz to 90 MHz.

Furthermore, the antenna of this embodiment was also found to be a very good antenna for FM radio band of 76 MHz to 90 MHz and of AM radio band of 500 KHz to 1700 KHz.

Fourth Embodiment

In this embodiment, the glass antenna system according to the third embodiment was modified in that the first horizontal strip 9 was in the form of a closed loop of a pair of parallel strips, as shown in FIG. 4.

With this modification, it was possible to obtain a higher receiving gain for the FM radio broadcast wave band and to improve the antenna gain in the AM radio broadcast wave band, as compared with the third embodiment.

Similar to the third embodiment, the antenna of this embodiment was also found to be a very good antenna for FM radio bands of 76 MHz to 90 MHz and AM radio band of 500 KHz to 1700 KHz.

What is claimed is:

1. A glass antenna system for a vehicle, comprising:

a rear window glass sheet;

a defogger formed on a lower part of the glass sheet, the defogger having horizontal heater strips and positive and negative bus bars for feeding an electric current to the heater strips; and an antenna formed on an upper part of the glass sheet, the antenna comprising:

(a) a feed point located at a position that is adjacent to a top or side member of a metal rear window frame of the vehicle, when the rear window glass sheet is fixed to the rear window frame;

(b) a first horizontal strip connected to the feed point, the first horizontal strip being adjacent to the top member of the rear window frame, when the rear window glass sheet is fixed to the rear window frame, to achieve a capacitive coupling with the rear window frame, the first horizontal strip extending across a vertical center line of the glass sheet to an end point such that a length defined from the feed point to the end point of the first horizontal strip is equal to "$\alpha\lambda/2$" where $\lambda$ represents a wavelength of a received frequency and $\alpha$ represents a wavelength shortening coefficient of 0.4 to 0.6;

(c) a first vertical strip vertically extending from the end point of the first horizontal strip toward the heater strips;

(d) a first return strip horizontally extending from a lower end of the first vertical strip toward a side of the feed point, the first return strip being away from the heater strips such that a distance between the first return strip and a top of the heater strips is equal to one-third or more of a distance between the top of the heater strips and the top member of the rear window frame when the rear window glass sheet is fixed to the rear window frame; and (e) a second return strip horizontally extending from a middle point of the first vertical strip toward the side of the feed point, wherein a total length of the first vertical strip and the first return strip is equal to "$\beta\lambda/4$" where $\lambda$ is defined as above and $\beta$ represents a wavelength shortening coefficient of about 0.7.

2. A glass antenna system according to claim 1, wherein the antenna further comprises a horizontal supplementary strip extending from the lower end of the first vertical strip in a direction that is opposite to the side of the feed point.

3. A glass antenna system according to claim 1, wherein the first horizontal strip comprises a pair of parallel strips of which both ends are closed.

4. A glass antenna system according to claim 1, wherein a distance between the first horizontal strip and the top member of the rear window frame is in a range of 1 mm to 10 mm, when the rear window glass sheet is fixed to the rear window frame.

5. A glass antenna system according to claim 1, wherein the distance between the first return strip and the top of the heater strips is in a range of 60 mm to 150 mm.

6. A glass antenna system according to claim 1, wherein a vertical length of the first vertical strip is in a range of 40 mm to 100 mm.

7. A glass antenna system according to claim 1, wherein the glass antenna system further comprises a circuit having at least a capacitor, the circuit being provided between and connected to the positive bus bar and a body of the vehicle as an earth.

8. A glass antenna system according to claim 1, wherein $\alpha$ represents a wavelength shortening coefficient of about 0.5.

* * * * *